United States Patent [19]

Cheng et al.

[11] Patent Number: 4,571,837

[45] Date of Patent: Feb. 25, 1986

[54] ELLIPSOGRAPH

[76] Inventors: Tien-Fu Cheng, 14, Pei Shan Road, Pei Shan Li, Hsi Chih City Tapei Hsien, Taiwan, 221; Lung-Chiao Chou, 1, Alley 9, Lane 250, Cheng Kung Rd., Sec. 2, Nei Hu, Taipei, Taiwan, 114

[21] Appl. No.: 637,199

[22] Filed: Aug. 3, 1984

[51] Int. Cl.[4] ..... B43L 11/04

[52] U.S. Cl. ..... 33/30.1; 33/30.14

[58] Field of Search ..... 33/27 R, 27 D, 27 F, 33/30 R, 30 D, 30 F, 30 G, 31

[56] References Cited

U.S. PATENT DOCUMENTS 3,500,544 3/1970 Hill ..... 33/30 D 3,820,245 6/1974 Yozzo ..... 33/30 R

FOREIGN PATENT DOCUMENTS 636233 3/1936 Fed. Rep. of Germany ..... 33/30 D

*Primary Examiner*—Richard R. Stearns

*Attorney, Agent, or Firm*—Armstrong, Nikaido Marmelstein & Kubovcik

[57] ABSTRACT

An improved ellipsograph for drawing ellipses, ovoids and circles comprises a frame, a slide block, a disc, a worm wheel, a pivot adjusting block, a stub adjusting block, a motor, a battery holder and a drawing arm. The disc and the worm are screwed together and fitted in the round opening of the slide block. The pivot adjusting block and the stub adjusting block are fitted respectively in the worm wheel and the disc. When the motor is started the screw shaft will cause the worm wheel to turn and the pivot on the pivot adjusting block will circumambulate with the worm wheel. At the same time, the stub on the stub adjusting block fitted in the slot of the frame will roll along the slot due to the tangential force of the worm wheel and cause the slide block with the worm wheel and the disc as a whole to move straightly back and forth. The combination of the circumferential and straight movements of the pivot and the adjustment of the locations of the pivot and the stub will cause the drawing arm fixed to the pivot to draw ellipses, ovoids, and circles on the paper in the place as preset with the positioning plate.

6 Claims, 13 Drawing Figures

ELLIPSOGRAPH

BACKGROUND AND SUMMARY OF THE INVENTION

It is troublesome to draw ellipses and the precision of such ellipses drawn is very low. The most common method of drawing ellipses is to determine points by distances from the center and to connect the points into elliptic outline. Although it is broadly used, it takes time and effort and is apt to have errors. Conventional elliptical compasses can draw standard ellipses but can not be used broadly because the number of ellipses they can draw is limited. There are many ellipsographs currently available but they can only draw one size of ellipse and can not be used for a special purpose.

Aimed at the above mentioned disadvantages, the inventor worked hard to make improvements and after many experiments, developed this improved ellipsograph which employs a motor to cause circumferential, and linear movements at the same time for drawing ellipses.

The improved ellipsograph of this invention comprises a base frame, a slide block fitted into sliding grooves formed in the inside of the frame and capable of sliding back and forth freely. A worm wheel and a disc each relieved longitudinally to receive a movable block, are superimposed upon each other, screwed together and fitted in the round opening of the slide block. A small motor with a screw shaft is mounted on one side of the slide block with the shaft in mesh with the worm wheel. A pivot block and a stub attached thereto are mounted adjacent to each other on the worm wheel and on the disc so as to be slidable therein, and a drawing arm fixed to the pivot. When the motoris started, it will cause the worm wheel to turn and the pivot will circumambulate with the worm wheel. At the same time, the stub, fitted into a stub slot formed in the base of the frame, will roll along the slot and the tangential force of the worm wheel will force the slide block to move back and forth. The synchronous combination of circumferential and linear movements of the pivot will cause the drawing arm to draw ellipses, ovoids, circles, etc., as determined by the position of the pivot block and stub block.

The pivot and the stub are adjustable and made as an integral part respectively of the pivot adjusting block and the stub adjusting block. The pivot adjusting block and the stub adjusting block are fitted respectively in the worm wheel and the disc and have a threaded hole each for a screw rod to adjust their positions so that the drawing arm will draw ellipses of different sizes. Besides, a positioning plate, fitted on the base frame, can be pulled out for positioning so that the drawing arm will draw ellipses in the preset place. The drawing arm can be extended for drawing larger proportional ellipses. This improved ellipsograph is simple in structure but can draw ellipses, ovoids, and circles of different sizes.

The main object of this invention is to provide an improved ellipsograph which is simple in structure, low in cost and readily draws standard ellipses in preset places.

Another object of this invention is to provide an improved ellipsograph which can be adjusted to draw a variety of ellipses, ovoids and circles of different sizes.

BRIEF DESCRIPTION OF THE DRAWINGS

Reference will be made to the attached drawings, in which.

DETAILED DESCRIPTION

Figure 1:
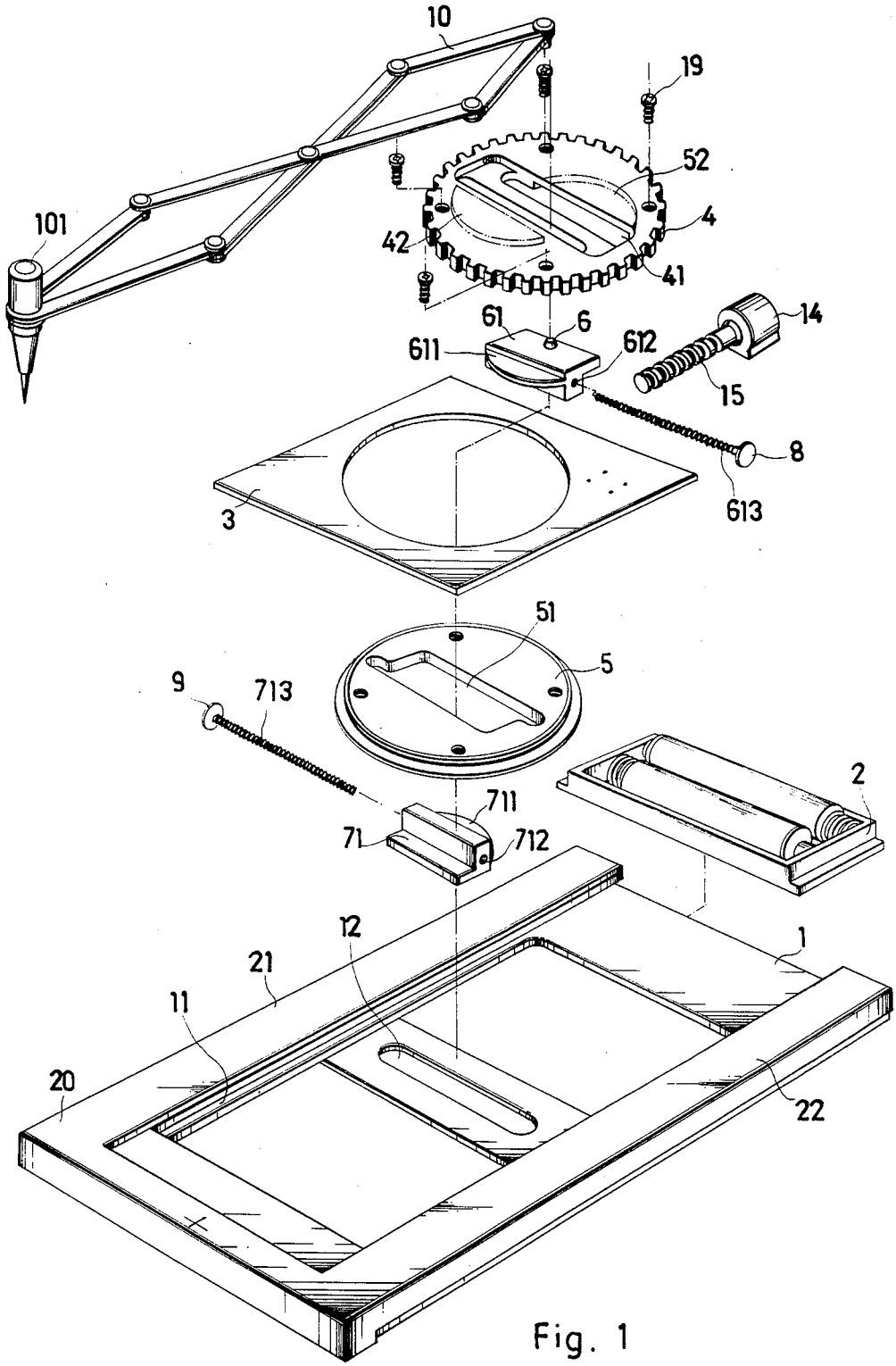
FIG. 1 is a vertical sectional view of the improved ellipsograph of this invention.
Figure 1B:
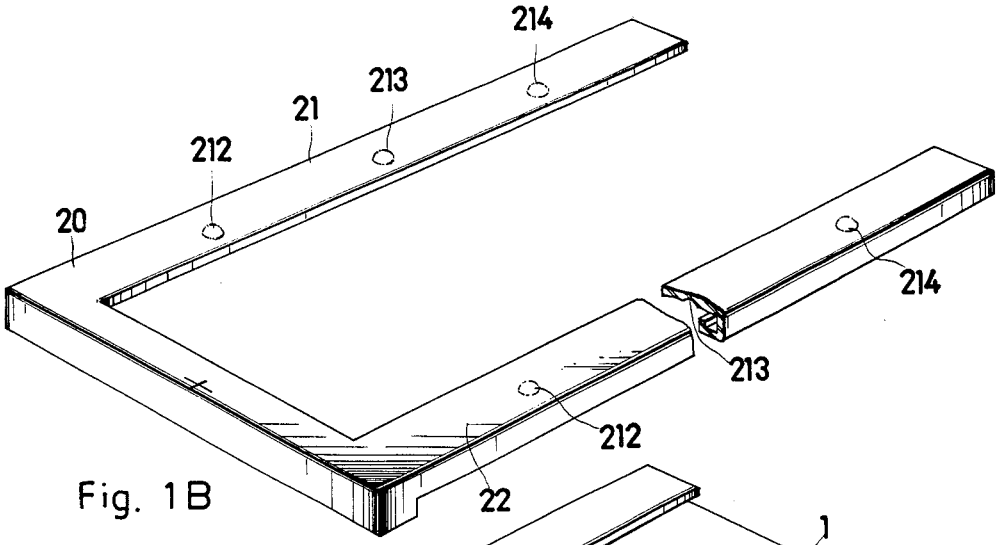
FIGS. 1A and 1B are sectional views of the base frame and the positioning plate as shown in FIG. 1.
Figure 1A:
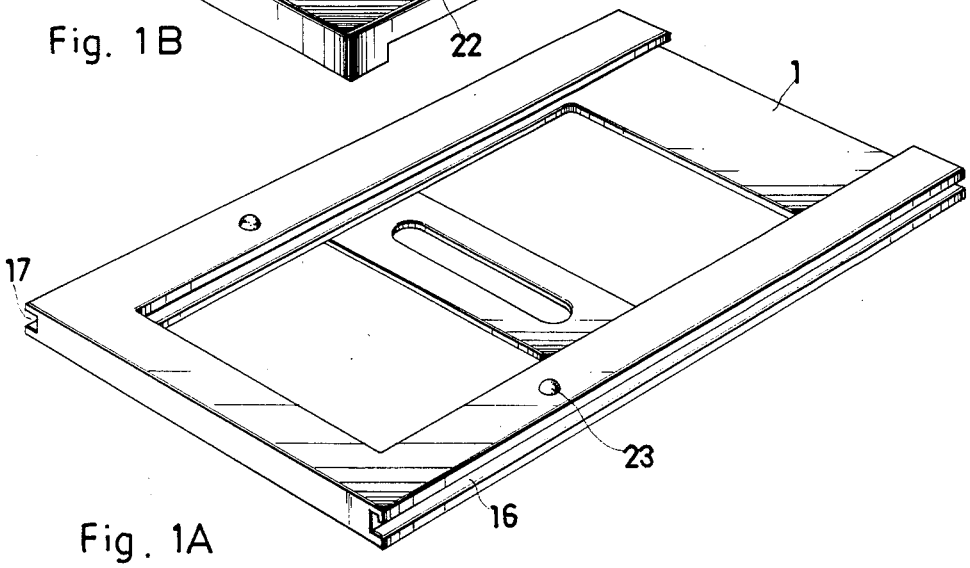
Figure 1C:
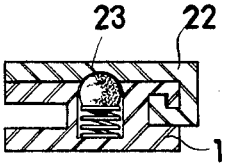
FIG. 1C is a section of the ball-tumbler hole in the base frame as shown in FIG. 1.

Now referring to the drawings, the improved ellipsograph of this invention consists of a base frame 1 having a sliding groove 11, a battery holder 2 being inserted in one end of the base frame 1, a slide block 3 being square in shape and having a round opening in the center, a worm wheel 4 and a disc 5 fitted in the opening of the slide block 3, a pivot 6 and a pivot adjusting block 61, a stub 7 (shown in FIG. 2A) and a stub adjusting block 71, a small motor 14 and a screw shaft 15, and a drawing arm. The worm wheel 4 and the disc 5 are screwed together and fitted in the opening of the slide block 3 in such way that the pivot adjusting block 61 and the stub adjusting block 71 are inserted respectively in the slots 41, 51 of the worm wheel 4 and the disc 5. The lips 611, 711 of the adjusting blocks 61, 71 are fitted in the semicircular slots 42, 52 of the worm wheel 4 by turning the adjusting screw heads 8, 9. The adjusting blocks 61, 71 have threaded holes 612, 712 respectively for the screws 613, 713 to fit in. By turning the screw heads 8, 9, the screws 613, 713 will cause the adjusting blocks 61, 71 to move. After the adjusting blocks 61, 71 are assembled, the worm wheel 4 and disc 5 are put together and fixed by means of screws 19 in such way that the assembly can turn freely in the opening of the slide block 3. The drawning arm 10, having a pencil holder 101 at the front end, is fixed to the pivot 6 of the adjusting block 61 mounted in the worm wheel 4. The stub 7 of the stub adjusting block 71 in the disc 5 is fitted in the slot 12 of the base frame 1. A small motor 14 is mounted on one side of the slide block 3 in such way that its screw shaft 15 is in mesh with the worm wheel 4. The base frame 1 has sliding grooves 16, 17 on both sides (as shown in FIG. 1A) for the two support pieces 21, 22 of the positoning plate 20 to slide on. A three-stage ball-tumbler check is composed by having two holes 23 in the base frame 1, three shallow holes 212, 213, 214 in each of the two support pieces 21, 22 of the positioning plate 20, and balls and springs in the holes 212, 213, 214 (as shown in FIG. 1C). This check device allows the positioning plate 20 to be positioned at three stages and permits the drawing arm 10 to draw multiple ellipses (to be described later). The three-stage positionings are: (1) at the hole 212, the positioning plate 20 is checked in its closed position, (2) at the hole 213, the positioning plate 20 is checked in its half-open position (for general use), (3) at the hole 214, the positioning plate is checked at its full open position (for drawing ellipses in multiple ratio).

Figure 2:
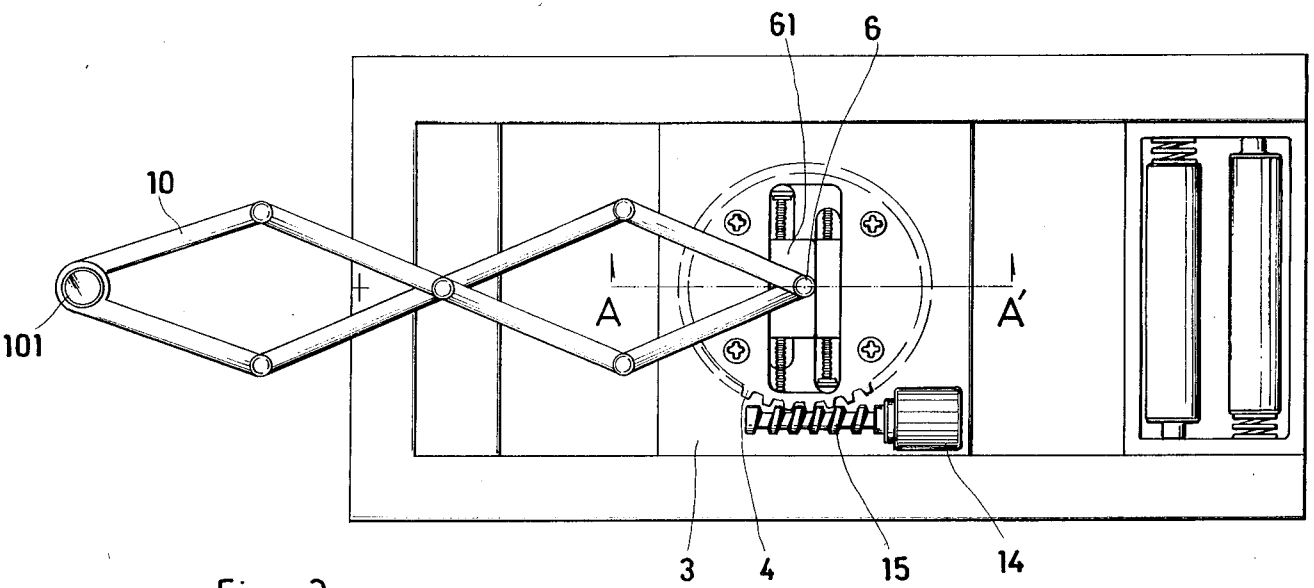
FIG. 2 is a front view of the improved ellipsograph of this invention.
Figure 2A:
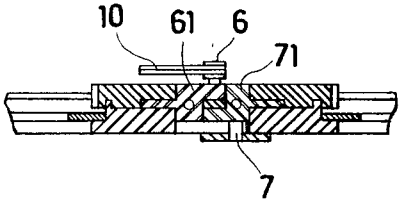
FIG. 2A is a detailed section by the A—A line of the improved ellipsograph as shown in FIG. 2.
Figure 3:
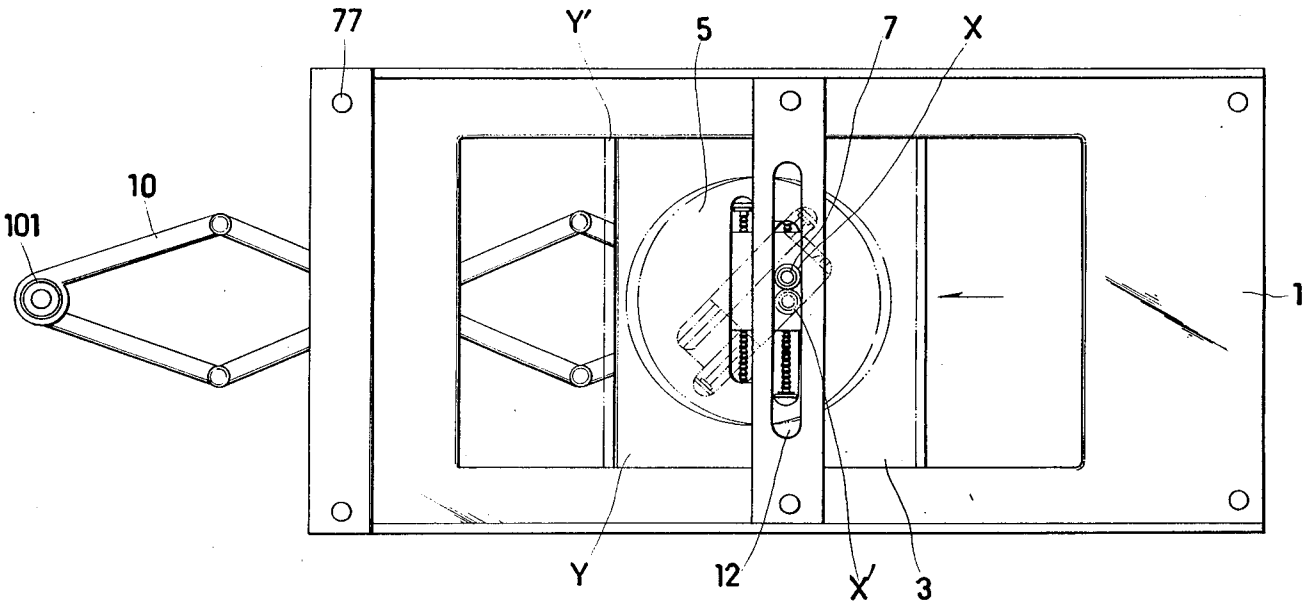
FIG. 3 is a back view of the improved ellipsograph of this invention illustrating the movements of the stub and slide block.

As shown in FIG. 2, when the motor 14 is started, the worm wheel 4 will turn with the screw shaft 15 of the motor. The pivot 6 of the pivot adjusting block 61 will circumambulate with the worm wheel 4. With the pivot 6 circumambulating, the drawing arm 10 will circumambulate synchronously. At the same time, the worm wheel 4 will cause the disc 5 to turn. The stub 7 of the adjusting block 71 is to circumambulate with the disc 5 but since it is fitted in the fitting slot 12 of the base frame 1 as shown in FIG. 3 and the tangential force is resolved into linear force, it can not circumambulate but rolls along the inside of the slot 12 and moves back and forth linearly. As a result, the slide block 3 moves back and forth linearly. Thus, the drawing arm 10 pivoted on the worm wheel 4 circumambulates with the worm wheel 4 while it moves back and forth with the slide block 3 on which the worm wheel 4 is mounted. The synchronous combination of these two movements causes the drawing arm 10 to draw regular figures such as ellipses.

As shown in FIG. 3, the real line indicates the position of the stub 7 and the slide block 3 before moving and the dotted line indicates the position after moving. Since the stub 7 is fitted in the slide slot 12, it can only roll along the slot 12. When the disc 5 turns with the worm wheel 4, the stub 7 can only move from the position X to the dotted line position X'. Meanwhile, the slide block 3 moves from the position Y to the dotted line position Y'.

In addition, the improved ellipsograph of this invention is equipped with footings 77 to provide a proper clearance between the bottom of the base frame 1 and the paper and to make the base frame 1 stand firmer.

Figure 4A:
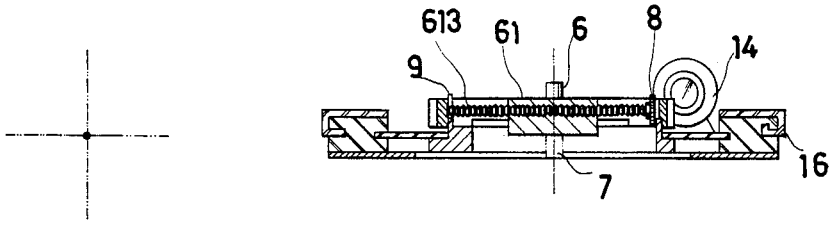
FIG. 4A shows that the pivot adjusting block and the stub adjusting block are in the center.
Figure 4B:
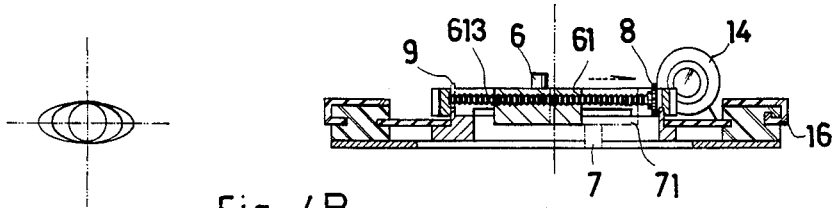
FIG. 4B shows that the pivot adjusting block remains unchanged (not in the center), and the stub adjusting block is adjusted outward.
Figure 4C:
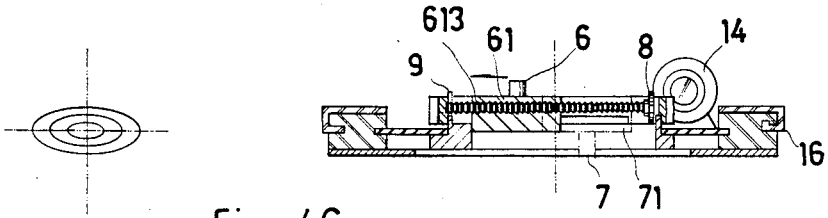
FIG. 4C shows that the pivot adjusting block is adjusted outward and the stub adjusting block remains unchanged (not in the center).
Figure 4D:
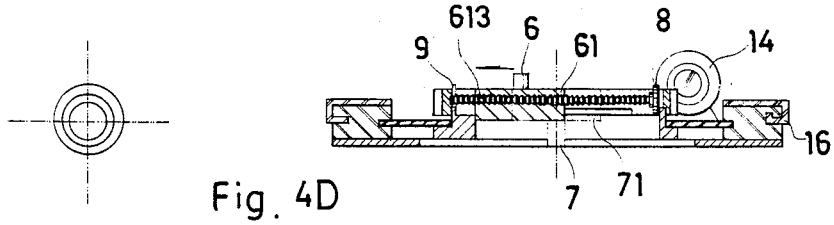
FIG. 4D shows that the pivot adjusting block is adjusted outward and the stub adjusting block is in the center.
Figure 4E:
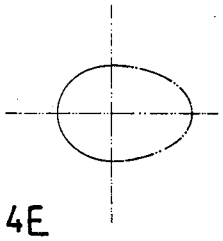
FIG. 4E illustrates the drawing of ovoids by the improved ellipsograph of this invention.

FIGS. 4A, 4B, 4C, 4D, 4E illustrate the adjustment of the pivot 6 and the stub 7 and the ellipses drawn thereby. When the pivot adjusting block 61 and the stub adjusting block 71 are adjusted to center the pivot 6 and the stub 7 with the adjusting screws 8, as shown in FIG. 4A, the drawing arm 10 will draw a point after the motor 14 is started. When the stub adjusting block 71 is adjusted outward (in the arrowed direction) with the position of the pivot adjusting block 61 remaining unchanged (not in the center), the drawing arm 10 will draw ellipses as shown in FIG. 4B. The diameter of these ellipses remains unchanged but with the outward moving of the stub 7, the distance between the two foci increases. On the contrary, when the pivot adjusting block 61 is adjusted outward (in the arrowed direction) with the position of the stub adjusting block 71 remaining unchanged (not in the center) as shown in FIG. 4C, the ellipses drawn are as shown in FIG. 4C. The distance between two foci and the diameter of these ellipses increase with the outward moving of the pivot 7. The greater the radius, the larger the ellipse. Moreover, the pivot 6 and the stub 7 can be centered as shown in FIG. 4A and then the pivot adjusting block 61 is moved outward (in the arrowed direction) to draw circles as shown in FIG. 4D. These circles are concentric but of different diameters. The ellipsograph of this invention can also be used to draw ovoids. The stub 7 and the pivot 6 are first adjusted to draw the elliptical half of the ovoid as shown in FIG. 4E. Then the stub adjusting block 71 is moved outward to increase the distance between the two foci to continue drawing the elongated half of the ovoid as shown in FIG. 4E.

Figure 5:
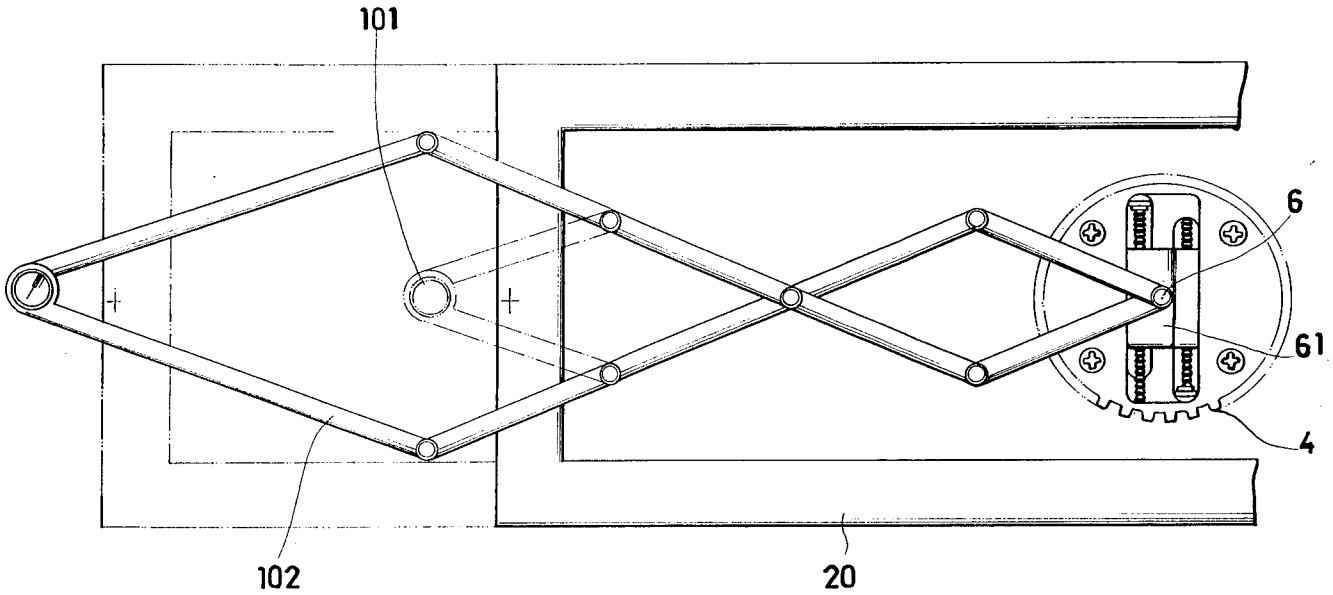
FIG. 5 illustrates the application of the positioning plate and drawing arm of the improved ellipsograph of this invention.

FIG. 5 illustrates the application of the positioning plate 20 and the drawing arm 10. A central line is first drawn on the paper on which ellipses are to be drawn (referring to FIGS. 1A, 1B). Then the positioning plate 20 is pulled out until it is checked at the second hole 213. When the center line on the paper is found to be superimposed through the transparency of the positioning plate, the ellipsograph is in the right place. After the positioning plate 20 is pushed back and checked at the first hole 212, the motor 14 will be started to drive the drawing arm 10 to draw ellipses in the set place. Extention 102 may be added to the drawing arm 10 to meet the requirement for larger ellipses. The third check hole 214 in the positioning plate 20 is designed for use with the extended drawing arm 10.

When the center of the positioning plate 20 superimposes the center line, the motor 14 may be started to cause the drawing arm 10 to draw ellipses in the set place. With the extention 102, the drawing arm 10 can draw larger ellipses without need to adjust the position of the stub 7 and pivot 6. Since the center of the positioning plate 20 is always on the central line and since the pencil holder 101 is always on the elliptic circumference, the pencil holder 101 will not be blocked by the positioning plate 20 at any position.

Accordingly, the improved ellipsograph of this invention which with precise mechanism and accurate drawing system can draw perfect ellipses is incomparable with conventional ellipsographs.

We claim:

1. An improved ellipsograph for drawing ellipses, ovoids and circles of various size and proportion comprising:

(a) a rectangular base frame having a slot at a bottom portion thereof formed in the direction of its width and further having an inner margin;

(b) a positioning plate slidably mounted thereupon, and extendible in the direction of the longer side of said base frame;

(c) a slide block having a circular central opening slidably mounted upon the inner margin of said frame;

(d) a battery holder affixed to one end of said frame;

(e) a worm gear wheel having a slot parallel to a diameter;

(f) a planar disc having a slot parallel to a diameter, said disc and said worm gear wheel being affixed to each other so that said slots are parallel and being rotatably mounted in the circular opening of the slide block;

(g) an adjustable pivot block having a projecting pivot fitted in said slot of said worm wheel, and being adjustable along the length of said slot;

(h) an adjustable stub block having a projected stub fitted in said slot of said disc and adjustable along the length of said slot, said stub projecting into said slot of said base frame;

(i) a drawing arm adjustable in length and having a holder for a drawing instrument, said arm being fixed to said pivot; and (j) a motor mounted upon one side of said slide block, said motor being connected to said battery holder by conductive wires and driving a shaft in mesh with said worm gear wheel.

2. An improved ellipsograph according to claim 1 wherein operation of the motor results in rotation of the worm gear wheel and movement of the projected stub in said slot causing the slide block to move laterally in a reciprocating fashion across the base frame so that the drawing arm describes a figure, the shape of which is determined by the offset of the pivot block and stub block within their respective slots.

3. An improved ellipsograph according to claim 1 wherein the base frame has inside sliding grooves for the slide block to move back and forth freely, and outside sliding grooves for support pieces of the positioning plate to advance and retreat firmly as they are checked by at least 1 three-stage ball-tumbler.

4. An improved ellipsograph according to claim 1 wherein the pivot adjusting block fitted in the slot of the worm wheel has a threaded hole for a screw rod to adjust the pivot adjusting block.

5. An improved ellipsograph according to claim 1 wherein the stub adjusting block fitted in the disc has a threaded hole for a screw rod to adjust the stub adjusting block.

6. An improved ellipsograph according to claim 1 wherein the positioning plate has shallow holes on a support piece to complete a three-stage ball-tumbler check with the base frame so that it can be pulled out for positioning and pushed back for the drawing arm to draw perfect ellipses at the preset location on the paper.

* * * * *